US006097017A

United States Patent [19]

Pickford

[11] Patent Number: 6,097,017

[45] **Date of Patent: *Aug. 1, 2000**

[54] MICROWAVE OVEN FOOD CONTAINER

[75] Inventor: Keith Pickford, Whitefield, United Kingdom

[73] Assignee: Novus Foods Limited, Manchester, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/894,612

[22] PCT Filed: Jan. 22, 1996

[86] PCT No.: PCT/GB96/00128

§ 371 Date: Jan. 16, 1998

§ 102(e) Date: Jan. 16, 1998

[87] PCT Pub. No.: WO96/22228

PCT Pub. Date: Jul. 25, 1996

[30] Foreign Application Priority Data

Jan. 21, 1995 [GB] United Kingdom ..... 9501224

[51] Int. Cl.[7] ..... H05B 6/80

[52] U.S. Cl. ..... 219/725; 99/DIG. 14

[58] Field of Search ..... 219/730, 732, 219/759; 426/107, 234, 241; 99/DIG. 14

[56] References Cited

U.S. PATENT DOCUMENTS

| | | | |
|---|---|---|---|
| 3,067,921 | 12/1962 | Reifers | 229/2.5 |
| 3,915,532 | 10/1975 | Ashton | 312/351 |
| 5,088,179 | 2/1992 | Gibbon | 29/458 |
| 5,310,977 | 5/1994 | Stenkamp et al. | 219/730 |
| 5,310,980 | 5/1994 | Beckett et al. | 219/709 |
| 5,423,477 | 6/1995 | Valdman et al. | 229/104 |

FOREIGN PATENT DOCUMENTS

| | | | |
|---|---|---|---|
| 0344726 | 12/1989 | European Pat. Off. . | |
| 2337534 | 8/1977 | France . | |
| 2343668 | 10/1977 | France . | |
| 2226220 | 11/1988 | United Kingdom | 219/730 |
| 2226220 | 6/1990 | United Kingdom . | |
| 8908549 | 9/1989 | WIPO . | |
| 9314995 | 8/1993 | WIPO . | |
| 9419917 | 9/1994 | WIPO . | |
| 9427887 | 12/1994 | WIPO . | |
| 9524110 | 9/1995 | WIPO . | |

*Primary Examiner*—Teresa Walberg
*Assistant Examiner*—Jeffrey Pwu
*Attorney, Agent, or Firm*—Workman Nydegger & Seeley

[57] ABSTRACT

A container for a food product (30) heated in a microwave oven comprises a base (2), one or more sides (3) extending from the base, said sides and base defining a receptacle for a food product and support means (5, 6) adapted to support the food product (30) above the base (2) to allow egress of water vapour from the food product in use.

18 Claims, 3 Drawing Sheets

MICROWAVE OVEN FOOD CONTAINER

This invention relates to a container of the type suitable for a food product which can be placed in a microwave oven to heat or reheat the food product.

Microwave ovens are quick and convenient for cooking or heating foods. In particular ready prepared foods can be reheated in a matter of minutes. This has led to the creation and rapid growth of "convenience foods"—ready prepared foods or meals which have been cooked or partially cooked and only require reheating in a microwave oven. Convenience foods are packaged in containers which are suitable for use in a microwave oven obviating any need to empty the food into another container for reheating. Some products are packaged in such a way that the reheated food can be eaten directly from the container which is disposed of after use.

Although microwave ovens heat foods very effectively, they have a tendency to render some food products unpalatable. This applies particularly to foods which would have a crisp or crunchy surface, for example, pastry cases or breadcrumb coatings. Microwave ovens also have a tendency to cause foods to soften thereby destroying the texture of the food. This limits the types of food products which can be supplied as convenience foods for reheating in a microwave oven.

According to the present invention a microwave oven food container comprises a base and one or more sides extending from the base to define a receptacle in which a food product can be heated in a microwave oven; support means adapted to support the food product above the base and arranged to define channels permitting egress of water vapour from the food product in use.

Preferred containers in accordance with the invention have. The surprising advantage that the texture of certain food products can be improved in comparison with the product being heated in a conventional microwave container. A disadvantage with conventional containers for microwave foods or meals is that the food is placed directly onto the base of the container. During heating in a microwave oven food fluids, for example juices from meats, sauces and steam, flow out of the food and accumulate in the tray. With many convenience food products this is not a problem and actually enhances the value of the food as the fluids can be presented as a sauce or gravy. However, some food products absorb the fluids creating a very soft and soggy texture. The container of the invention ensures that such absorption is minimised. Furthermore, by supporting the food product above the base air circulation around the food is increased, juices and water vapour can be emitted from the underside of the food without being absorbed by the outer surface. This further improves the texture of coated foods and pastry products which are cooked in a microwave oven.

In preferred containers the support means comprises a multiplicity of protrusions extending from the base, each protrusion having a surface disposed at an acute angle in relation to the base. The angled surfaces of the protrusions facilitate reflection and deflection of microwave and thermal radiation toward the food product.

In preferred embodiments the surfaces of adjacent protrusions are disposed in opposed relation. Preferably the opposed surfaces are perpendicular.

In preferred embodiments of the invention the surfaces are disposed at an angle of 45° in relation to the base. This arrangement optimizes reflection and deflection of radiation towards the food product.

The protrusions are preferably arranged in an array to define a corresponding array of channels for egress of water vapour and drainage of fluids away from the food product.

Each of the protrusions may taper to a point. Contact with a food product placed in the container is reduced to a minimum. Pointed protrusions provide the maximum possible surface area for emission of water vapour and food fluids from a food product during cooking.

Preferably each of the protrusions are pyramidal. Alternatively each of the protrusions may be conical. A rectangular pyramidal configuration is especially preferred.

The protrusions may be arranged in the shape of a letter, word or logo. This has the advantage that the container can carry a publicity display or may identify the food product therein.

Containers in accordance with this invention may also afford greater heating efficiency than conventional flat bottomed trays. For example when using a standard flat bottomed tray it was found that 140 g of food product could be heated in a 850 watt microwave oven to 80° C. in 3 minutes. Use of a tray with pyramidal protrusions reduced the heating time to 2 minutes.

One or more ribs may be provided in the sides or base of the container. By providing ribs in the sides or base of the container the rigidity and strength of the product can be increased.

Preferably a lip extends outwardly along the edges of the sides of the container. A lip allows the container to be handled more easily, enhances strength and rigidity, and provides a surface to which a cover may be sealed by heating or by use of an adhesive.

Containers in accordance with this invention are preferably composed of a polymeric material including a radiation absorbent filler. A preferred filler is carbon, for example particulate carbon black or comminuted carbon fibres. Preferred polymeric materials include polyethylene, polypropylene, polyethylene terephthalate and copolymers and blends thereof.

Use of a food grade of polypropylene is preferred for example material manufactured under the trade mark NOVOLEN 1102J (BASF).

Preferred polymeric materials may be pigmented with carbon black. For example the polypropylene may be blended with polypropylene having a carbon black content of 40% incorporating carbon black with a particle size of 20 nm. The carbon black blend may be added to polypropylene to give a loading of 2 to 20% according to the required thermal conductivity.

The increase in heating efficiency caused by reflection and deflection of radiation avoids or reduces formation of cold spots. Furthermore the container becomes hot during irradiation and heat transmission from the container to the food product continues after cessation of the irradiation cycle. Drying and crisping are enhanced in comparison to an unpigmented container.

Food products in accordance with this invention may include a cover comprising a sleeve which is adapted to slide in use over the container, the cover including at least one locking member moveable from a first position in which the cover can slide over the container, to a second position in which the locking member engages the container to prevent the cover from being moved relative to the container.

This packaging has the advantage that the cover can be removed from the container so that a food product can be heated in a microwave oven and the cover replaced so that the heated food can be transported. The cover reduces heat loss from the food product and surrounds the container thereby insulating the container and reducing heat loss through the sides and bases. The packaging is suitable for take away restaurants, public houses or cafes. However, it must be appreciated that the packaging could be used in other circumstances where food is cooked. One known type of container comprises an aluminium foil container sealed by a card lid. The card lid is held in place by bending the edges of the aluminium onto the lid. However, aluminium containers are unsuitable for use in a microwave oven and existing microwave containers cannot be bent or deformed without splitting or fracturing. The packaging of the invention overcomes these disadvantages.

Preferably the locking member locates in a recess provided in the container to prevent the cover being removed. The recess eliminates the need to provide locking means at each end of the sleeve to prevent the container from slipping out.

The locking member may be a flap provided in the sleeve. The flap can be pushed into the recess to prevent relative movement between the cover and the container.

Preferably, the sleeve includes two surfaces, the surfaces meeting at an edge; wherein the locking member comprises a pair of substantially parallel fold lines located either side of the edge, and a web of sleeve material between the fold lines; said web being adapted to engage the container to prevent relative movement between the cover and the container. This construction of locking member has the advantage that the web of material is retained in an engaged position.

Preferably the sleeve is composed of card.

Embodiments of the present invention will now be described, by way of example only, with reference to the accompanying drawings, in which.

Figure 3:
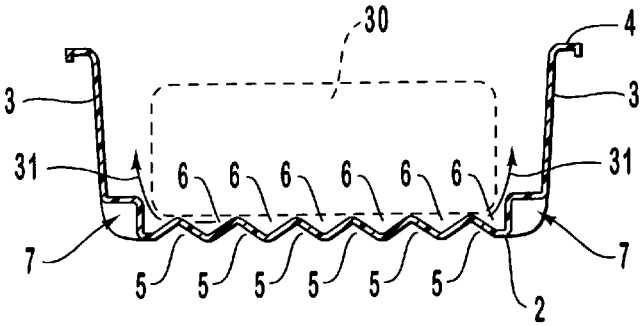
Figure 4:
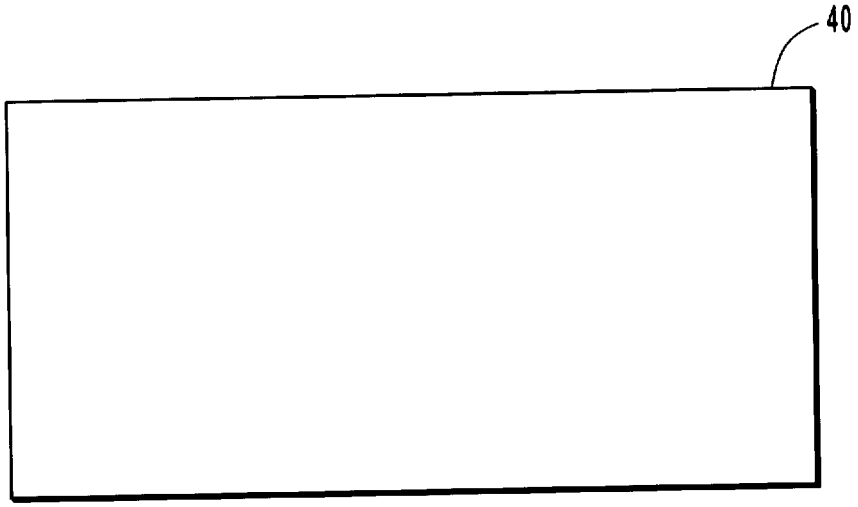
Figure 5:
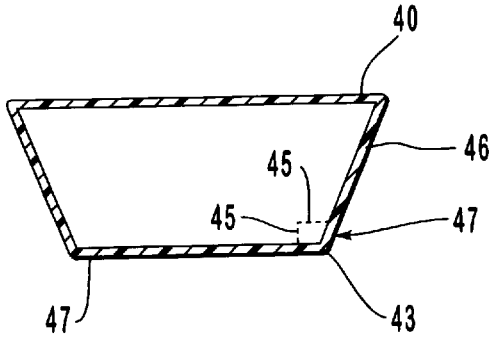
Figure 6:
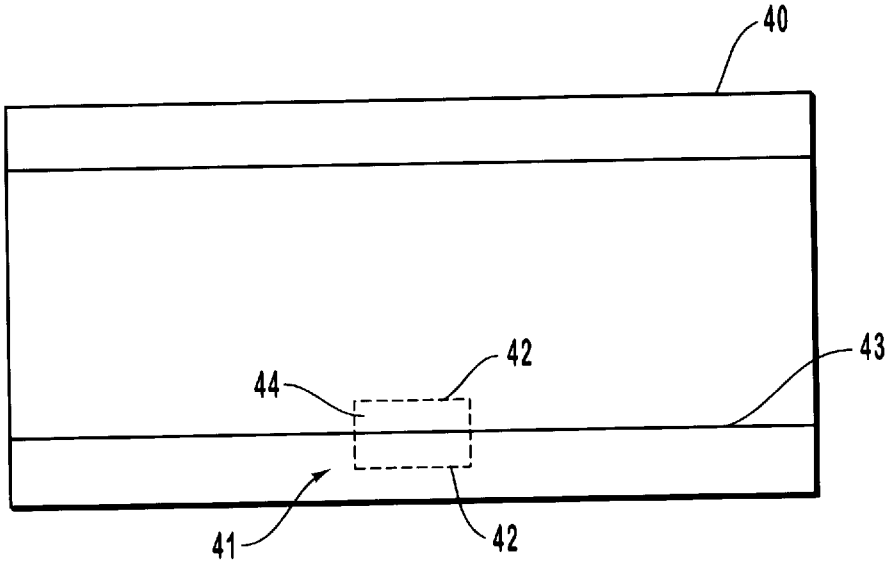
Figure 7:
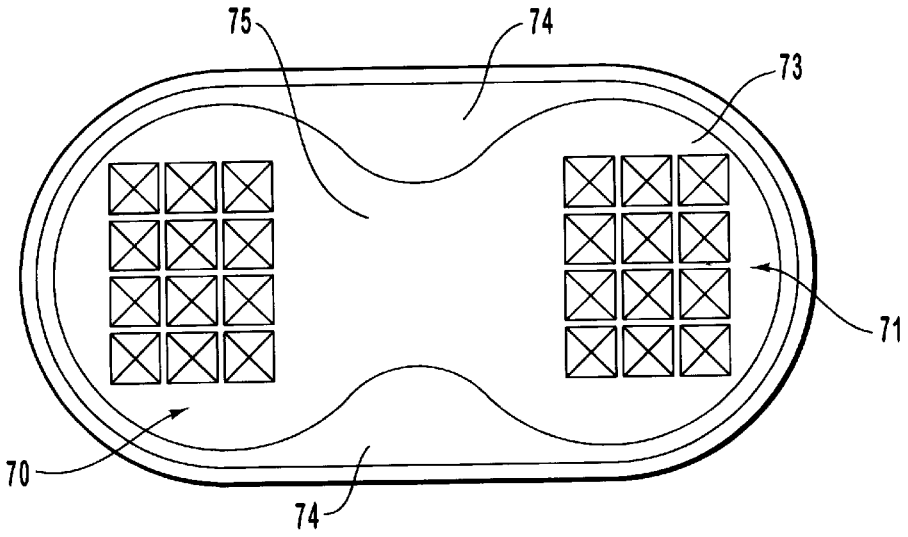
Figure 8:
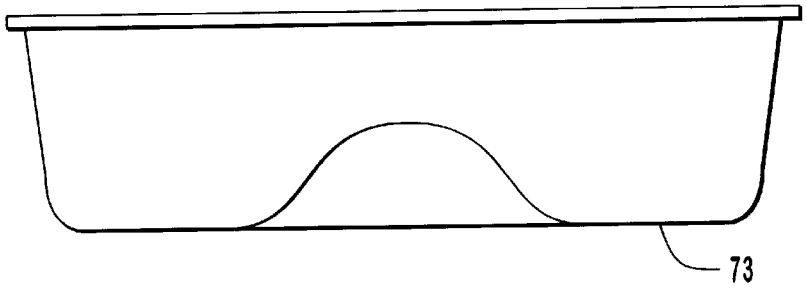
Figure 9:
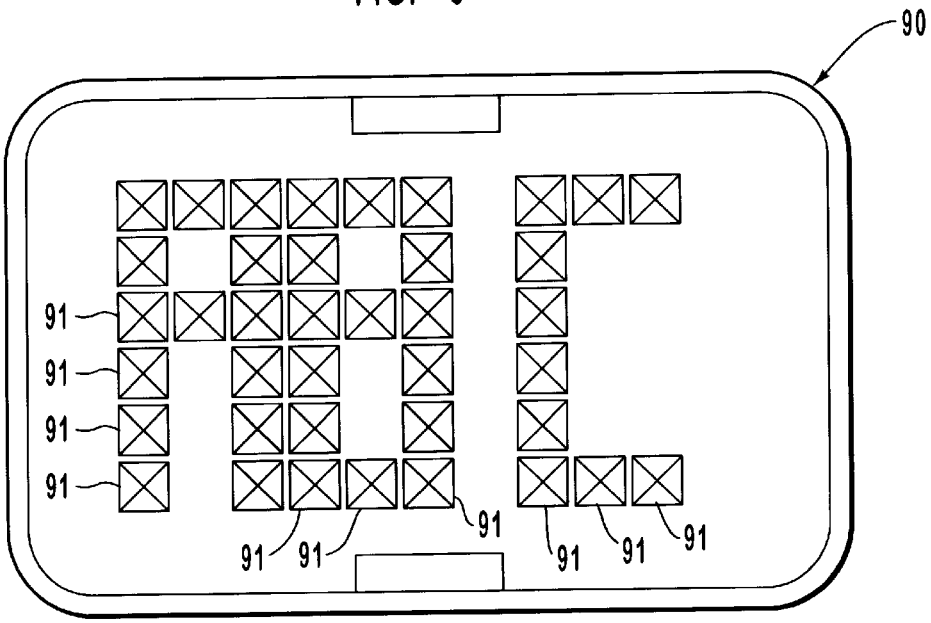

FIG. 3 is a cross-sectional view along the line AA of the container in FIG. 1 and showing the position of a food product in the container, FIG. 4 is a plan view of a cover of packaging according to the invention, FIG. 5 is a side view of the cover shown in FIG. 4, FIG. 6 is a view from below of the cover shown in FIGS. 4 and 5, FIG. 7 is a plan view of a container suitable for holding two food items or portions, FIG. 8 is a side view of the container shown in FIG. 7, and FIG. 9 is a plan view of a container showing a patterned arrangement of the protrusions.

Figure 1:
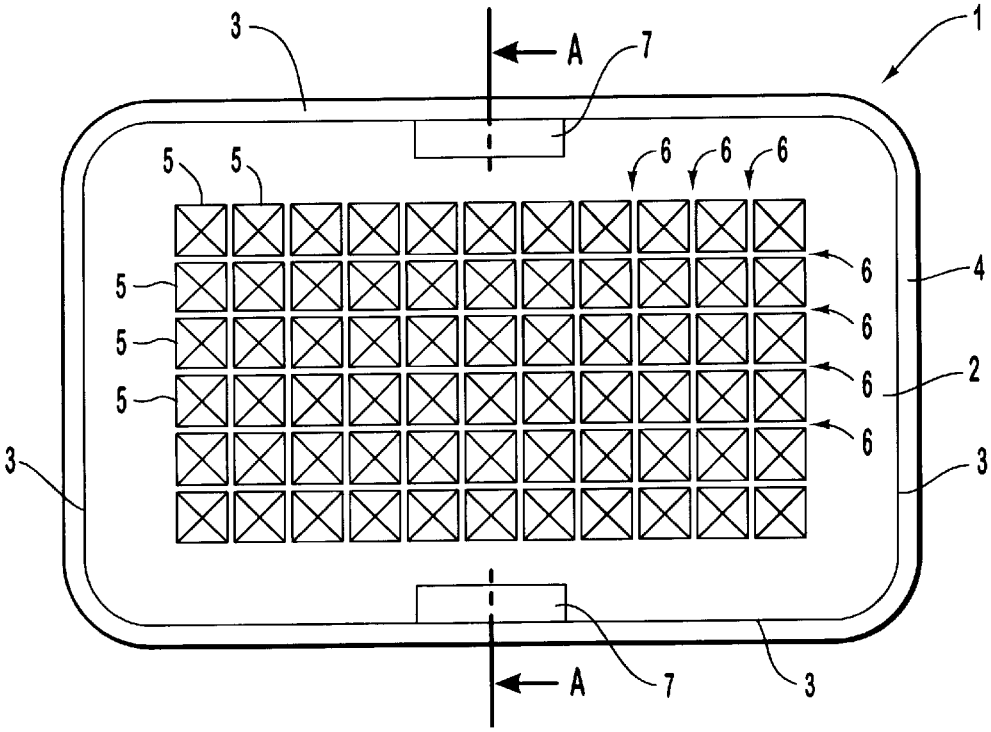
FIG. 1 is a plan view of a container according to the invention.
Figure 2:
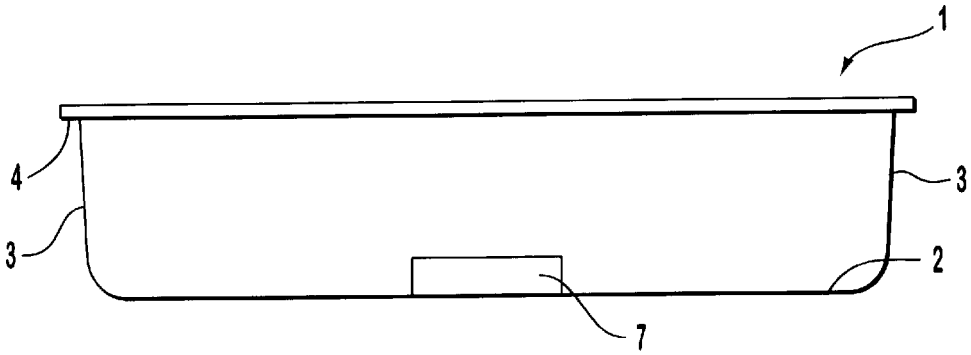
FIG. 2 is a side view of the container shown in FIG. 1.

Referring to the drawings in detail, FIGS. 1 and 2 show a container according to the invention, generally indicated by reference numeral 1. The container 1 comprises a base 2 and four sides 3 extending upwardly from the base 2 to define a receptacle in which a food product may be held. A lip 4 is formed along the edges of the sides 3 which enhances the strength and rigidity of the container but also provides a surface on which a lid or plastic film can be adhesively bonded to keep food fresh and free from contaminants. An array of protrusions 5 extend upwardly from the base 2 and are adapted to support a food product above the base. The array of protrusions 5 define channels 6 between adjacent protrusions 5 which allow drainage of food fluids, for example juices and moisture, onto the base 2. The arrangement of the protrusions 5 and channels 6 provide efficient drainage or passage of water vapour and liquids from the whole of the underside of a food product.

The protrusions each have a surface disposed at an acute angle relative to the plane of the base. The inclined surfaces of the protrusions are preferably disposed perpendicular to corresponding surfaces of adjacent protrusions. In the embodiments shown in FIGS. 1 and 3 the protrusions comprise rectangular pyramides, the sides of which are inclined at an angle of 45° to the horizontal base. Alternatively adjacent protrusions may have sides inclined at 30° and 60° respectively.

The protrusions are pyramid shaped and taper to a point which maximises the surface area of food which can emit steam or juices without causing the food to soften or become soggy. Thus the container helps food products to retain their texture. The food is separated from any juices during cooking and this reduces softening from absorption and also improves air circulation. The container comprises a plastic material which is suitable for use in a microwave. The protrusions may form truncated pyramids or cones so that puncture of he foodstuff or injury to a user's fingers are avoided.

FIG. 3 shows a food product 30 being supported above a base 2 during cooking. The protrusions 5 have a stall surface area in contact with the food product 30. Arrows 31 indicate the flow of steam or moisture from the food product during cooking. The moisture or steam escapes around the sides of the food product and out of the container via the channels 6 between the protrusions 5. Other food fluids, for example juices, can drain into the base of the container and can collect away from the food product.

FIGS. 4–6 depict a cover for a container which comprises an open ended sleeve 40 composed of card which is adapted to slide over a container. Illustrations and instructions for cooking the food product can be printed on the outside of the sleeve. The cover also includes a locking member 41 which is adapted to locate in a recess 7 provided in the container see FIGS. 1–3). The locking member 41 prevents relative movement between the cover and the container when the locking member is located in the recess 7. The locking member comprises two fold lines 42 located on either side of an edge 43 formed between the surfaces 46, 47 of the sleeve 40, and a web 44 of sleeve material between the fold lines. The web 44 can be pushed inwards to the configuration shown by dotted lines 45 in FIG. 5. In this position the web 44 would locate in a recess 7 in the container thereby preventing relative movement between the cover and the container. An advantage of this locking member is that it is retained in the locked or unlocked configuration by the geometry of the sides 46 and 47 of the sleeve. Movement of the web 44 from the engaged position to the disengaged position is resisted.

The cover can be used to keep food hot once it has been heated. For example, a pre-prepared meal can be supplied in a container sealed with a film. The film is removed or pierced and the container and food are placed in a microwave oven. The food is heated for the required amount of time in the oven. When cooking has finished the cover is slid over the container. The web 44 is pushed inwards so that it locates in the recess 7 in the container thereby locking the cover in place. The sleeve surrounds the container and reduces heat loss through the sides and base.

FIGS. 7 and 8 depict a further container which is adapted to hold two portions of food product. Each of the portions of food are supported on an array of protrusions 70 and 71 which extend from the base 73. The sides 74 curve towards each other at about half way along the container. This forms a constriction 75 in the middle of the container which helps to keep the food portions separated and also ensures that each of the food portions are supported by their respective array of protrusions 70 and 71.

FIG. 9 shows a container 90 in which the protrusions 91 are arranged to depict the letters ABC. Containers can be customised to display an attractive pattern, message or logo.

Containers in accordance with this invention may be manufactured from any material which is suitable for use in a microwave oven. Polyolefins are preferred, for example polyethylene, polypropylene or blends or copolymers thereof. Especially preferred polymers are filled with a radiation absorbent material, for example a pigment such as carbon. Alternative pigments may be employed. Carbon may comprise carbon black or comminuted carbon fibres. A convenient material for blending with polypropylene is a blend of polypropylene having a carbon black content of 40%, the carbon black having a particle size of 20 nm. This blend may be added to the polypropylene to give a loading of 2 o 20% according to the required thermal conductivity.

In a comparative trial two samples of water, 25 $cm^3$ were heated in a 800 watt microwave oven for 10 seconds in a polypropylene tray pigmented with carbon black and a second unpigmented tray respectively. It was found that on average the heat gain in the pigmented container was 62% whereas in the unpigmented container the heat gain was 59%. It was noted that the pigmented container gained an appreciable degree of heating whereas the unpigmented container was quite cool after heating. When heating foodstuffs, especially ready meals, there is a tendency for microwave radiation to focus on certain materials such as fats or sugar. This can lead to formation of cold spots. Containers in accordance with this invention have a beneficial effect on heating efficiency and the occurrence of cold spots is reduced or eliminated.

I claim:

1. A container for heating a food product within a microwave comprising:

a base having a side extending therefrom so as to at least partially define a receptacle in which the food product can be disposed; and a plurality of protrusions integrally formed with the base and upwardly projecting therefrom to a free top end, the protrusions being configured to support the food product directly on the top ends thereof when the food product is received within the receptacle, the protrusions being configured to define channels permitting egress of water vapor from the food product while retaining within the receptacle any liquids from the food product, the protrusions being comprised of a microwavable polymeric material having radiation absorbent filler dispersed therein.

2. A container as recited in claim 1, wherein the base, sidewall, and plurality of protrusions are integrally molded together as a single unit.

3. A container as recited in claim 2, wherein the base, sidewall, and plurality of protrusions are each comprised of a microwavable polymeric material having radiation absorbent filler dispersed therein.

4. A container as recited in claim 1, wherein the top end of each protrusion has a surface disposed at an acute angle relative to a horizontal plane.

5. A container as recited in claim 4, wherein the surface at the top end of adjacent protrusions are disposed in opposed relation.

6. A container as recited in claim 1, wherein the surface at the top end of each of the protrusions is disposed at an angle of 45° in relation to a horizontal plane.

7. A container as recited in 1, wherein each of the protrusions has a substantially pyramidal configuration.

8. A container as recited in 1, wherein each of the protrusions has a substantially rectangular pyramidal configuration.

9. A container as recited in 1, wherein each of the protrusions has a substantially conical configuration.

10. A container as recited in 1, wherein the radiation absorbent filler is comprised of carbon.

11. A container as recited in 1, wherein the radiation absorbent filler is selected from the group consisting of carbon particulate and carbon fibers.

12. A container as recited in 1, wherein the polymeric material is selected from the group consisting of polyethylene, polypropylene, copolymeris, and blends thereof.

13. A container for heating a food product within a microwave comprising:

a base having a side extending therefrom so as to at least partially define a receptacle in which the food product can be disposed;

a plurality of protrusions each upwardly projecting from the base to a free top end having an acute angle formed thereat, the protrusions being configured to support the food product on the top ends thereof when the food product is received within the receptacle, the protrusions being configured to define channels permitting egress of water vapor from the food product while retaining within the receptacle any liquids from the food product; and the base, sidewall, and plurality of protrusions being integrally molded together as a unit comprised of a microwavable plastic having a carbon filler dispersed therein.

14. A container as recited in 13, wherein each of the protrusions has a substantially pyramidal configuration.

15. A container as recited in 13, wherein each of the protrusions has a substantially conical configuration.

16. A container as recited in 13, wherein the carbon filler is selected from the group consisting of carbon particulate and carbon fibers.

17. A container as recited in 13, wherein the polymeric material is selected from the group consisting of polyethylene, polypropylene, copolymeris, and blends thereof.

18. A container as recited in 13, further comprising a cover configured to selectively the receptacle.

* * * * *

UNITED STATES PATENT AND TRADEMARK OFFICE

CERTIFICATE OF CORRECTION

PATENT NO. : 6,097,017
DATED : August 1, 1997
INVENTOR(S) : Keith Pickford

It is certified that error appears in the above-identified patent and that said Letters Patent is hereby corrected as shown below:

Column 1,
Line 32, change "have. The" to -- have the --

Column 4,
Line 3, after "rectangular" change "pyramides" to -- pyramids --
Line 16, after "of" change "he" to -- the --
Line 19, after "have a" change "stall" to -- small --

Column 5,
Line 13, after "2" and before "20%" change "o" to -- to --
Line 15, after "heated in" change "a" to -- an --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*